US005131099A

United States Patent [19]

Zellweger

[11] Patent Number: 5,131,099

[45] Date of Patent: Jul. 21, 1992

[54] SOCK AND PROCESS FOR PRODUCTION THEREOF

[76] Inventor: Max Zellweger, Alte Wollerauerstr. 36, Richterswil, Switzerland

[21] Appl. No.: 780,837

[22] Filed: Oct. 23, 1991

Related U.S. Application Data

[63] Continuation of Ser. No. 368,025, Jun. 19, 1989, which is a continuation-in-part of Ser. No. 49,137, May 12, 1987, abandoned.

[30] Foreign Application Priority Data

May 16, 1986 [CH] Switzerland ..... 1992/86

[51] Int. Cl.[5] ..... A41B 11/12; D04B 9/46

[52] U.S. Cl. ..... 2/239; 66/172 E; 66/172 R; 66/194; 66/196

[58] Field of Search ..... 2/240; 66/172 R, 172 E, 66/178 R

[56] References Cited

U.S. PATENT DOCUMENTS

| | | | |
|---|---|---|---|
| 1,577,752 | 3/1926 | Price | 66/172.5 |
| 1,686,172 | 10/1928 | Porte | 66/194 |
| 2,081,026 | 5/1937 | Westerman | 2/240 |
| 2,144,563 | 1/1939 | Davis | 66/182 |
| 2,183,862 | 12/1939 | Davis, Jr. | 66/172 E |
| 2,220,803 | 11/1940 | Lesher | 66/172.5 |
| 2,263,523 | 11/1941 | Smith, Jr. | 66/172 E |
| 2,324,035 | 7/1943 | Smith, Jr. | 66/172 E |
| 2,435,770 | 2/1948 | Clarke | 66/182 |
| 2,661,612 | 12/1953 | Crawford | 66/172 R X |
| 2,702,998 | 3/1955 | Purcell | 66/178 |
| 2,719,416 | 10/1955 | Saunders | 66/14 |
| 2,974,508 | 3/1961 | Westmoreland | 66/172 R X |
| 2,977,782 | 4/1961 | Sheek | 66/173 |
| 3,122,906 | 3/1964 | Crawford | 66/172 E |
| 3,249,110 | 5/1966 | Bryan | 128/519 |
| 3,327,500 | 6/1967 | Currier | 66/187 |
| 3,392,553 | 7/1968 | Burleson | 66/172 E |
| 3,468,139 | 9/1969 | Bitzer | 66/194 |
| 3,625,029 | 12/1971 | Safrit | 66/172 E |
| 3,729,956 | 5/1973 | Nebel et al. | 66/172 E |
| 3,793,851 | 2/1974 | Thorneburg | 66/185 |
| 3,796,067 | 3/1974 | East | 66/178 |
| 4,043,151 | 8/1977 | Schmidt | 66/9 R |
| 4,162,620 | 7/1979 | Raevich et al. | 66/187 |
| 4,172,370 | 10/1979 | Safrit et al. | 66/92 |
| 4,373,361 | 2/1983 | Thorneburg | 66/178 R |
| 4,571,960 | 2/1986 | Hursh et al. | 66/196 |
| 4,732,015 | 3/1988 | Abrams et al. | 66/172 E |

FOREIGN PATENT DOCUMENTS

| | | | |
|---|---|---|---|
| 680621 | 9/1939 | Fed. Rep. of Germany . | |
| 963871 | 3/1948 | France . | |
| 1287120 | 1/1962 | France . | |
| 151656 | 3/1932 | Switzerland . | |
| 470078 | 9/1969 | Switzerland . | |
| 717180 | 2/1980 | U.S.S.R. | 66/172 E |
| 420664 | 12/1934 | United Kingdom . | |
| 2044815 | 10/1980 | United Kingdom . | |

OTHER PUBLICATIONS

*Weft Knitting Technology* 7 pages [no author].

*Knitting Dictionary*, pp. 48–49 and 74–75, edited by Charles Reichman.

*Primary Examiner*—Werner H. Schroeder

*Assistant Examiner*—John J. Calvert

*Attorney, Agent, or Firm*—Egli International

[57] ABSTRACT

The sock is produced as a knitted mesh article and at least in the sock leg has concave holding elements formed as thread bows and which are directed in the direction towards the foot. The height-to-length ratio of the thread bows directed downwardly is selected such that the loops when wearing on the leg and in the case of leg movements serve to produce a movement of the entire mesh article, e.g. sock, in the direction away from the foot. The holding elements are formed as the meshes of a loop plush, in which the loops serving as the holding elements are constituted by the thread bows. This is achieved in simple manner in that at least part of the meshes are formed from a plush thread and a basic thread, whereof the mesh head is directed towards the edge of the sock while the holding elements in the form of loops are directed towards the foot. Thus, the sock can be manufactured as a loop plush.

3 Claims, 3 Drawing Sheets

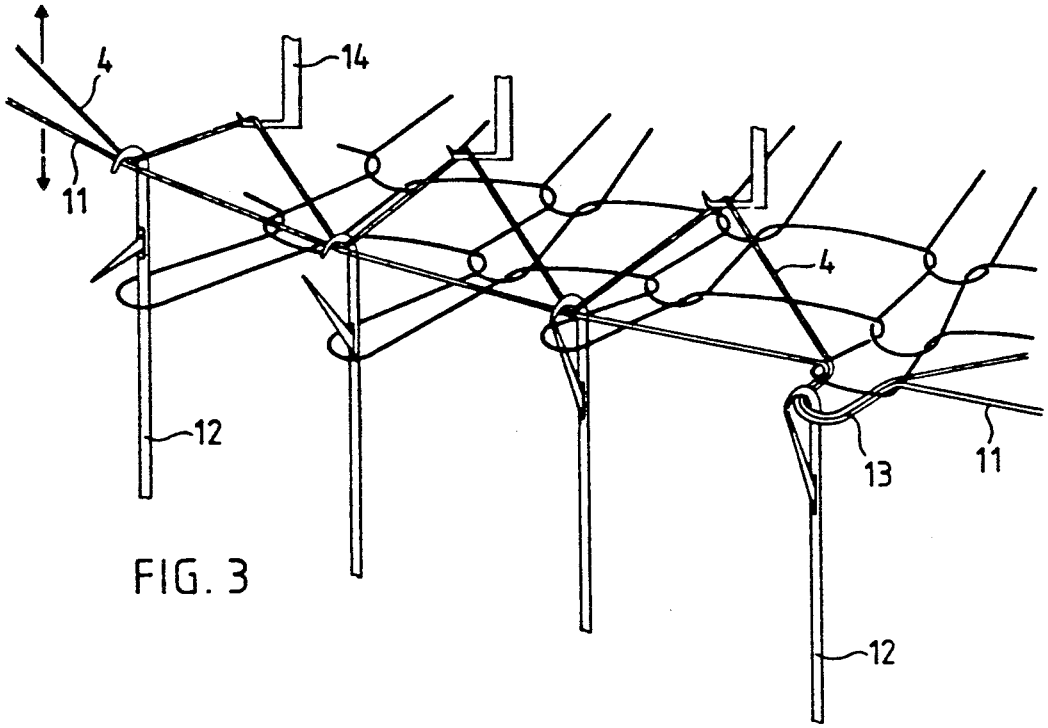
FIG. 3
FIG. 4
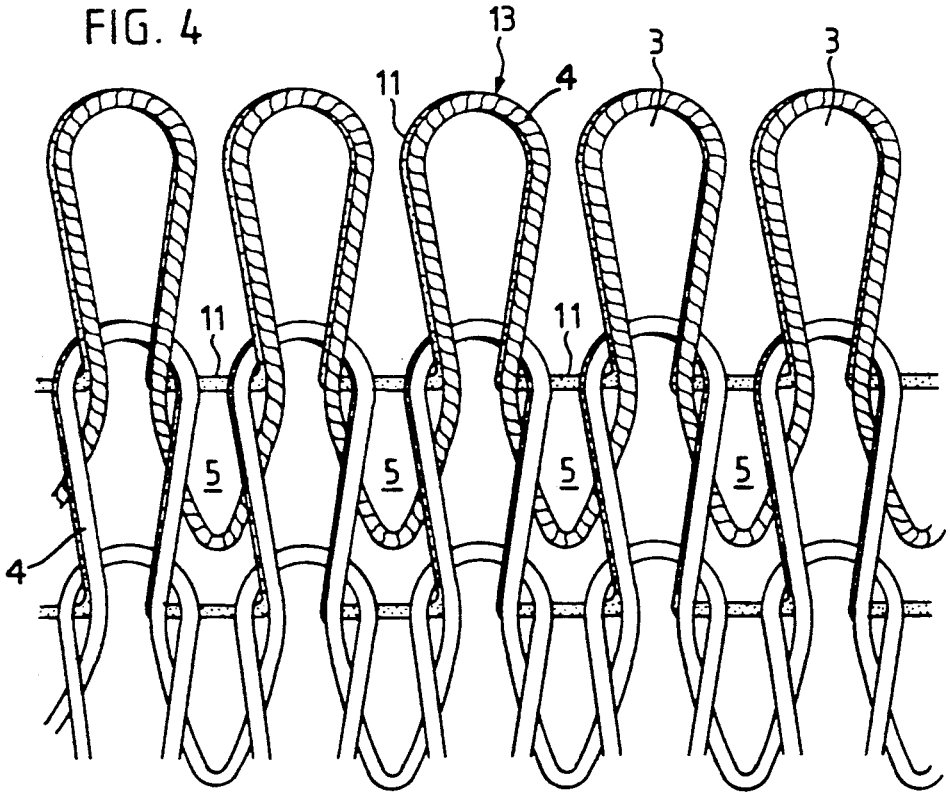

SOCK AND PROCESS FOR PRODUCTION THEREOF

CROSS REFERENCE TO A RELATED APPLICATION

This is a continuation of co-pending application Ser. No. 07/368,025, filed on Jun. 19, 1989, which is a continuation-in-part of application Ser. No. 049,137 filed May 12, 1987 which is now abandoned.

BACKGROUND OF THE INVENTION

The present invention relates to a sock in the form of a knitted mesh or stitched article produced from threads, in which the mesh article has concave holding elements as well as to a process for producing the sock.

Socks having substantially elastic holding elements to prevent the sock from slipping from the leg are known in numerous different forms. In most constructions in the case of the mesh article in the form of a knitted fabric additional threads are provided, which are made from a rubber-elastic material or a stretch material. Although such a thread material is able to ensure that the sock adheres to the leg, the disadvantage exists that the leg is constricted due to the elasticity of the thread material and as a result blood circulation is impeded. If such a sock is worn for a long time, this can lead to a considerable deterioration in the well-being of the wearer.

In another known sock construction (EP 0 068 455), the described disadvantage is avoided in that holding elements are formed on the inside of the mesh article and have the form of a concave thread bow or arc directed towards the foot part of the sock. In the case of leg movements of the wearer, e.g. when walking, the circumference of the leg changes, so that the thread bow is stretched and then relaxed again. However, as the thread bow does not return to its original position and instead is higher, this leads to an overall movement and consequently a tightening of the mesh article away from the foot, so that during each leg circumference change the sock is tensioned again. The important point is that this smoothing of the mesh article leads to no constriction of the leg circumference. The circulation of the blood is in no way impeded, but the mesh article is still permanently smoothed and engaged in creaseless manner on the wearer's leg.

However, the production of such thread bows on the mesh article of the known type is relatively complicated, which has made it difficult to put into practical use.

In an earlier application Serial No. 393,024 filed Jun. 28, 1982 and thereafter abandoned after appeal, applicant suggested socks with holding arrangements including convexly curved holding elements formed by single threads and provided on at least a portion of the sock body. The socks produced in accordance with that earlier patent application did not, however, provide a substantial stretch and tightening effect without use of rubber bands.

SUMMARY OF THE INVENTION

It is an object of the present invention to form a sock of the aforementioned type which, whilst retaining the mesh article tightening effect, permits a significant increase in the production rate.

According to the invention this and other objects are attained by a sock having a knitted thread mesh structure comprising an edge stop; a knitted border disposed adjacent the stop and secured thereto; a heel, a sock foot secured to the heel, the sock foot terminating in a tip; and an elongated sock leg secured at one end to the border and at the other end to the heel, said sock leg being formed of thread meshes each mesh employing two threads, one thread being a basic thread and the other thread having a plush thread forming a loop plush, said meshes including mesh heads directed away from said tip and towards said edge stop, and concave holding elements in the form of exposed thread bows forming mesh loops, said loops being directed towards said tip and away from said edge stop, said exposed thread bows having a length in the direction parallel to a transversal direction of the sock leg and a height in the direction of elongation of the sock leg, and wherein a height-to-length ratio of said thread bows is in the range between 0.2 and 0.75.

The holding elements are appropriately meshes formed from double threads, whereof one thread forms part of the basic knitted fabric and the other thread is the plush thread forming the loop. It is advantageous, as a function of the thread material used for producing the mesh article, for the loops to be formed in each mesh or in every other mesh of the knitted fabric.

In an embodiment, each mesh contains holding elements loops.

In another embodiment, every other mesh contains holding element loops.

In a further embodiment, the sock leg is composed of two mesh layers, one layer being an inner layer, the other layer being an outer layer, the inner layer being at least partially in loop plush form with holding elements or loops. The outer layer may cover the loops of the inner layer.

In an embodiment, parts of the inner mesh layer provided with loops is covered by the outer layer formed from knitted bindings of a random type.

In order to produce socks having a knitted mesh structure including an edge stop, a knitted border disposed adjacent the stop and secured thereto, a heel, a sock foot secured to the heel, the sock foot terminating in a tip, and an elongated sock leg secured at one end to the border and at the other end to the heel, wherein the sock leg is formed of thread meshes, each mesh employing two threads, one thread being a basic thread and the other thread being a plush thread forming a loop plush and the meshes including mesh heads directed away from the tip and towards said edge stop and concave holding elements in the form of exposed thread bows forming mesh loops, the loops being directed towards said tip and away from said edge stop, a new process is suggested, in which the knitting process is started from the binding-off zone, following the knitting of a toe, the foot, the heel, the sock leg, the sock border and ending the knitting at the edge stop of the sock, and in the step of knitting the sock le the ratio between the height and the length of exposed thread bows forming mesh loops is selected to be in the range between 0.2 and 0.75.

The sock or mesh article having holding elements shaped according to the present invention enables a movement of the mesh article away from the foot during wearer's leg movements so that a rubber band at the welt of the sock can be omitted.

The aforementioned objects, features and advantages of the invention will, in part, be pointed out with particularity, and will, in part, become obvious from the following more detailed description of the invention, taken in conjunction with the accompanying drawing, which form an integral part thereof.

BRIEF DESCRIPTION OF THE DRAWINGS

FIG. 3 is a perspective exploded view illustrating the production of the sock according to the invention;

FIG. 4 illustrates a detail of the mesh article of a sock according to FIG. 2 with a loop constituting the holding element in each mesh;

DETAILED DESCRIPTION OF THE PREFERRED EMBODIMENTS

Figure 1:
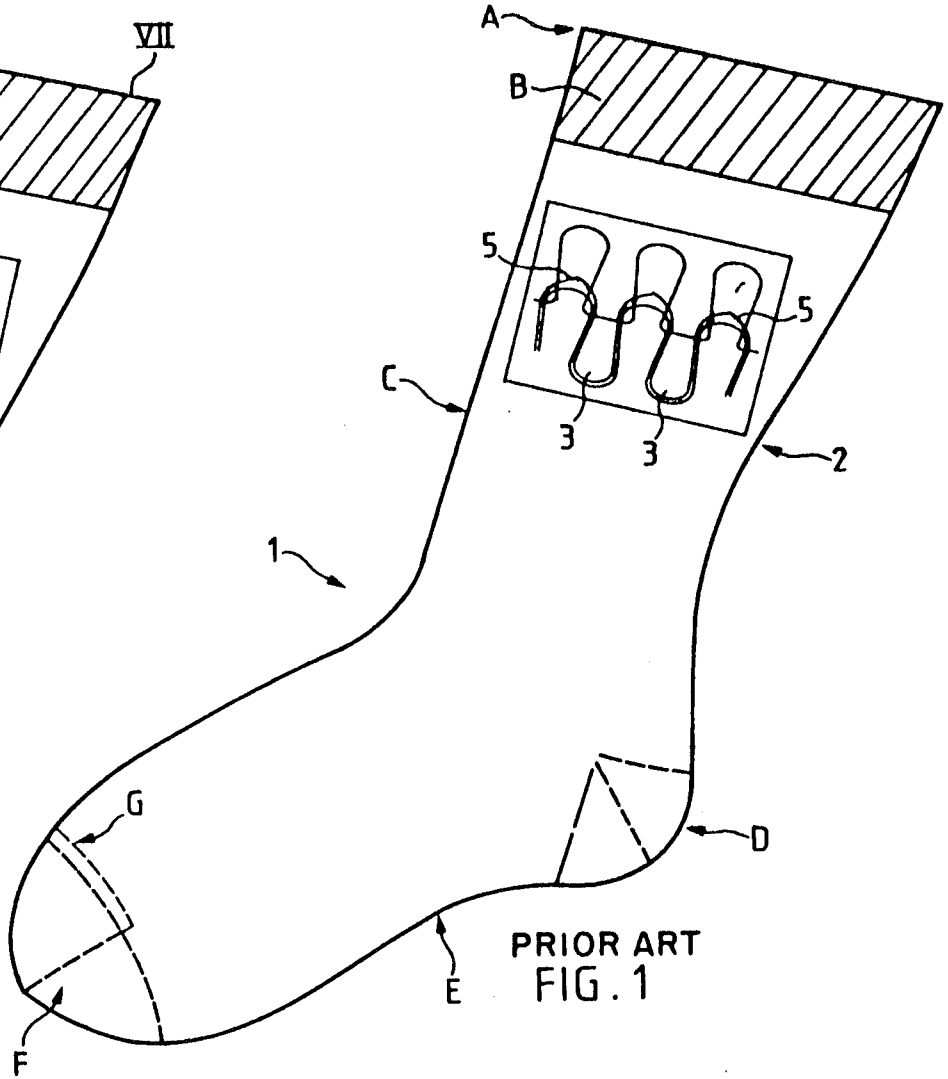
PRIOR ART FIG. 1
FIG. 1 is a diagrammatically represented side view of a sock produced in the known manner.

FIG. 1 shows a sock 1, e.g. for men in diagrammatic form and which is knitted in known manner as loop plush. The knitting process begins at end A of sock leg 2 with a normal edge stop and then in B the sock border is knitted and in it are placed elastic, e.g. rubber threads. This is followed at a C by the sock leg, in which different knitted bindings are knitted in, followed by heel D and finally foot E, which can also be knitted with plush loops. The sock toe or tip F is then knitted in the same way as heel D. G is the binding-off zone, which is used for closing the toe and then the knitting process is ended.

In sock leg C the knitted fabric is shown on a larger scale in a window. It is typical that mesh heads 3 and the loops 5 simultaneously knitted with a plush thread 4 are directed away from the sock foot towards the sock edge A.

The invention is based on the idea that it would be appropriate for achieving a high production capacity, if the same knitting process could be used for producing the loop plush, so that the holding elements formed from the thread bows could be knitted in the same way with meshes, and as a result of the specific shaping of the thread meshes as will be described hereinafter, the tightening function of the sock leg 2 would be reliably achieved.

Figure 2:
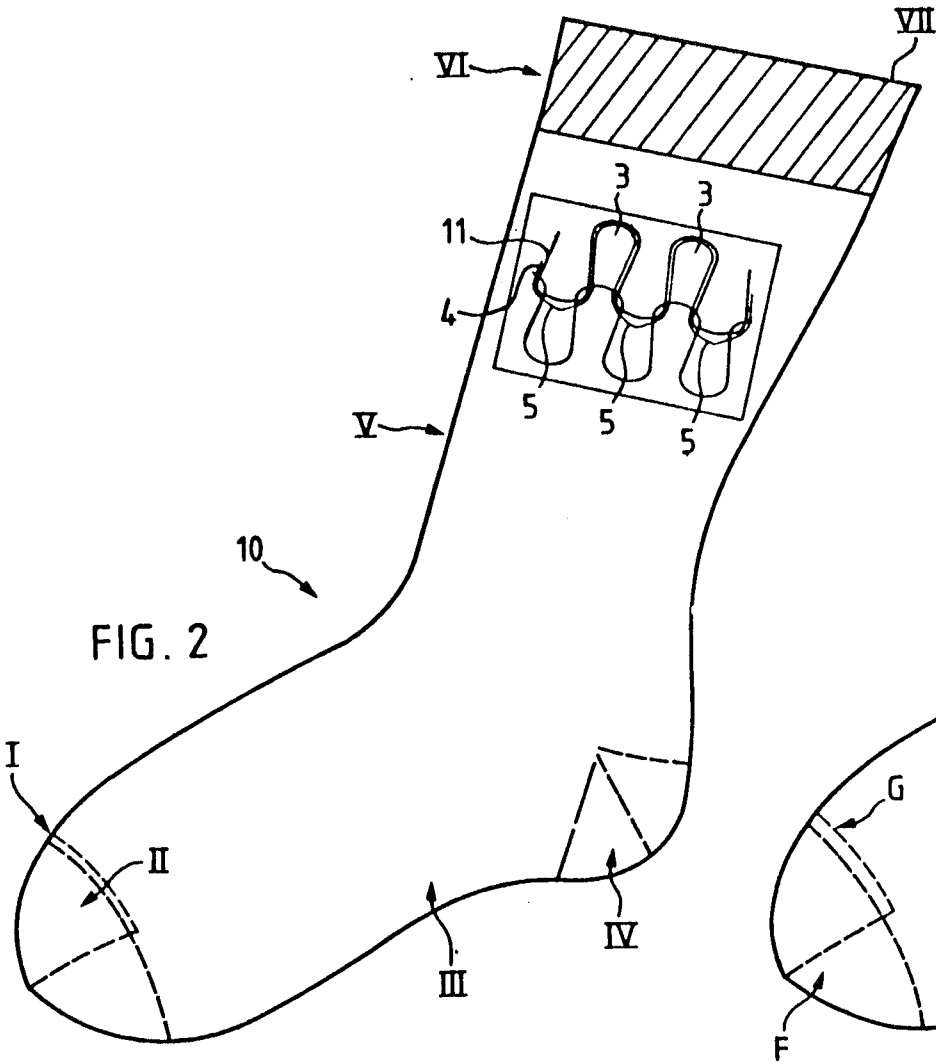
FIG. 2 is a diagrammatically represented side view of a sock according to the invention.

It has surprisingly been found that this objective can be achieved by reversing the knitting process and, at the same time, by selecting a predetermined height-to-length ratio of the loops which serve as holding elements. This is illustrated in FIG. 2 with a sock 10, in which the knitting begins at zone I, i.e. in the binding-off zone, and then, following the knitting of toe II, foot III, heel IV, sock leg V, sock border VI, ends at edge VII. The knitted fabric is shown on a larger scale in the window in sock leg V. According to the invention and as a result of the reversed knitting process the mesh heads 3' are directed upwards, whereas the loops 5' are directed downwards towards the foot of the sock. The reversed knitting process and a predetermined height-to-length ratio of loops 5' as will be explained in connection with FIG. 6, make it possible to give the loops the form of thread bows which, on changing the leg circumference, e.g. when walking, move in the direction of edge VII and therefore fulfill the sock tightening function. The effect of so-shaped thread bows is so substantial that rubber bands at the sock edge can be dispensed of.

FIG. 3 shows the known plush production, which is now also used for producing the inventive sock. From a basic thread 11 and a plush thread 4 double meshes 13 are knitted by means of knitting needles 14, whilst by means of plush thread 4 using plush plates 14 the loops are formed as holding elements 5 of a predetermined shape.

Figure 5:
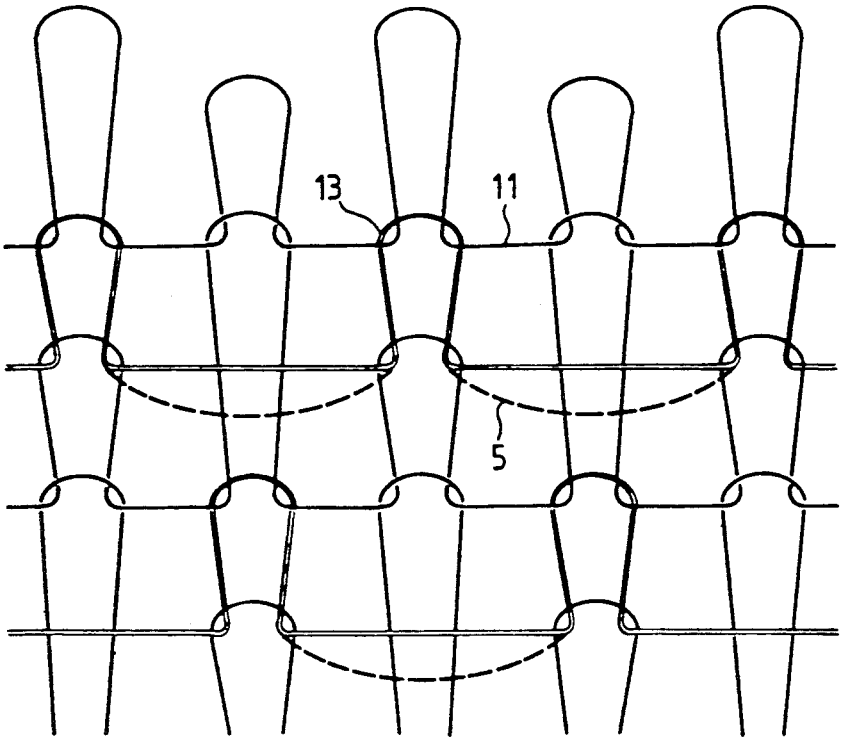
FIG. 5 shows a detail from a mesh article with holding elements in loop form in every other mesh, wherein the holding elements form concave thread bows directed towards the foot of the sock.

FIGS. 4 and 5 show two knitted fabrics with downwardly directed holding elements in the form of loops 5: which are interengaged with and positioned inwardly of mesh heads 3' of the previous row. In the knitted fabric according to FIG. 4, the loops 5" constituting the holding elements are knitted in each mesh while in the arrangement of FIG. 5 holding elements 5" are knitted in every other mesh. The knitted fabric according to FIG. 4 has a mesh structure suitable for knitting a wool sock, whilst the knitted fabric according to FIG. 5 has a mesh structure with which appropriately a cotton sock is knitted.

Figure 6:
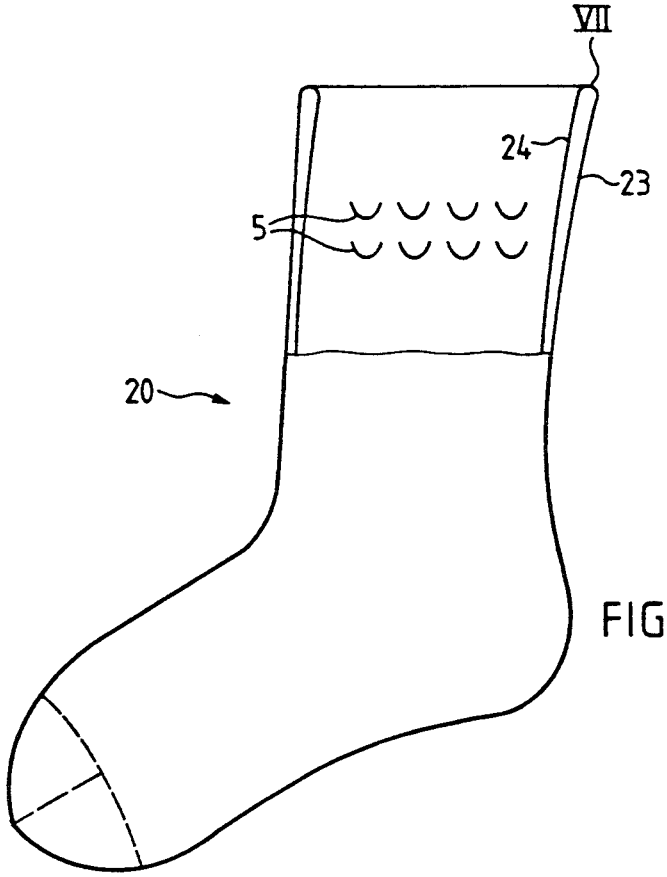
FIG. 6 is a diagrammatically represented section through a sock with a double-layer mesh article in the leg, in which the inside mesh article has holding elements formed as concave thread bows directed towards the sock foot and wherein a predetermined height-to-length ratio of the concave thread bows is shown.

FIG. 6 schematically illustrates a selected or predetermined ratio between the height h of the loops formed by threaded bows 5 and their length 1. This ratio in accordance with the invention is between 0.2 and 0.75. This ratio in combination with the reverse direction of knitting provides a surprising stretching-tightening effect so that in case the sock was unintentionally pulled down the leg portion moves back in the upward direction as a sock wearer walks or swings the leg.

FIG. 6 further shows the sock mesh which is formed in the sock leg with two superimposed knitted fabrics 23, 24. The inner knitted fabric 24 is produced in such a way that on inverting into the interior of sock 20 it has the same loops 5 in the form of concave holding elements directed towards the sock foot as in the embodiment of FIG. 2. The outer knitted fabric 23 can have a random mesh structure. The foot can also be knitted with a different mesh structure. In spite of this, as a result of the inner knitted fabric 24 with the loops 5 constituting holding elements, the tightening function of the sock is ensured.

Due to the fact that the holding elements exerting the tightening function of the sock 1, 10, 20 are constructed as specially shaped loops 5, it is possible to produce the sock in a rational manner, expenditure being no greater than when producing a normal loop plush.

The sock can be made without rubber in its welt but will yet maintain its tightening function without impeding blood circulation of the sock wearer. If the thread is of wool no preparation of the same is necessary since its natural elasticity is sufficient. However, a cotton thread changes its length substantially (up to 40% of the normal length) if it becomes moist and loses its contact with the leg. To avoid this the thread may be made more resilient artificially, e.g. as for crimped or stretched yarn. However, this is suggested only for securing surface pressure contact in all situations. Synthetic yarns may be also made somewhat resilient to ensure sock-leg contact in all situations.

There has been disclosed heretofore the best embodiment of the invention presently contemplated. However, it is to be understood that various changes and modifications may be made thereto without departing from the spirit of the invention.

What is claimed is:

1. A sock having a knitted thread mesh structure comprising:

an edge stop;

a heel;

a sock foot secured to the heel; and an elongated sock leg interposed between said edge stop and the heel;

said sock leg being formed of thread meshes comprising two non-elastomeric threads, one thread being a basic thread used throughout the thread mesh structure of said sock leg, and the other thread being a plush thread, at each mesh or at alternate meshes said plush thread being knitted with the basic thread into double-thread mesh heads directed upwardly towards said edge stop with a plush loop formed between each successive double-thread mesh head, the plush loops extending downwardly and inwardly toward a leg of a wearer for contacting the leg of the wearer to provide upward movement of said sock leg away from said sock foot during movement of the leg of the wearer.

2. The sock of claim 1, wherein each of the plush loops has a height-to-length ratio in the range of between 0.2 and 0.75.

3. A method of making a sock comprising the steps of:

initiating knitting at a toe portion of the sock, following with knitting a sock foot and a heel;

thereafter knitting a sock leg with at least a portion thereof knitted in a thread mesh structure with two non-elastomeric threads, one thread being a basic thread used throughout the thread mesh structure of the sock leg and the other thread being a plush thread, at each mesh or at alternate meshes knitting said plush thread with the basic thread into double-thread mesh heads directed upwardly away from the sock foot with a plush loop formed between each successive double-thread mesh head, the plush loops extending downwardly and inwardly toward a leg of a wearer and having a height-to-length ratio in the range between 0.2 and 0.75; and ending the knitting at an upper edge stop of the sock;

whereby the plush loops contact the leg of the wearer to provide upward movement of the sock leg away from the sock foot during movement of the leg of the wearer.

* * * * *